US010436168B2

(12) United States Patent
Ledesma Ledesma et al.

(10) Patent No.: US 10,436,168 B2
(45) Date of Patent: Oct. 8, 2019

(54) AIR STARTER AND METHODS FOR DETERMINING HYDROSTATIC LOCK

(71) Applicant: GE Aviation Systems LLC, Grand Rapids, MI (US)

(72) Inventors: Saul Ledesma Ledesma, Queretaro (MX); Ruben Blanco Aviles, Queretaro (MX); Aquiles Tiscareno Macias, Queretaro (MX)

(73) Assignee: GE Aviation Systems LLC, Grand Rapids, MI (US)

( * ) Notice: Subject to any disclaimer, the term of this patent is extended or adjusted under 35 U.S.C. 154(b) by 82 days.

(21) Appl. No.: 15/579,198

(22) PCT Filed: Jul. 8, 2015

(86) PCT No.: PCT/US2015/039460
§ 371 (c)(1),
(2) Date: Dec. 2, 2017

(87) PCT Pub. No.: WO2017/007463
PCT Pub. Date: Jan. 12, 2017

(65) Prior Publication Data

US 2018/0135586 A1 May 17, 2018

(51) Int. Cl.
*F02N 11/10* (2006.01)
*F02N 7/08* (2006.01)
(Continued)

(52) U.S. Cl.
CPC ..... *F02N 11/106* (2013.01); *F02N 7/08* (2013.01); *F02B 3/06* (2013.01); *F02D 41/062* (2013.01)

(58) Field of Classification Search
CPC ..... F02N 11/106; F02N 7/08; F02D 41/062; F02B 3/06
See application file for complete search history.

(56) References Cited

U.S. PATENT DOCUMENTS 2,842,937 A 7/1958 Clark
3,927,359 A 12/1975 Chen
(Continued)

FOREIGN PATENT DOCUMENTS

DE 3604284 A1 8/1987
GB 1331572 A 9/1973
WO 2012171049 a1 12/2012

OTHER PUBLICATIONS

Worcester Polytechnic Institute, Project No. ECCA082, Engine Hydrostatic-lock Mitigation, Steven Danley, Christopher Egan and Christopher Lyons.

(Continued)

*Primary Examiner* — Mark A Laurenzi
*Assistant Examiner* — Shafiq Mian
(74) *Attorney, Agent, or Firm* — McGarry Bair PC

(57) ABSTRACT

Air starter and methods for determining hydrostatic lock in a combustion engine during a start sequence with an air starter, including during the start sequence of the combustion engine, monitoring a speed parameter indicative of a rotational speed of the turbine air starter and a pressure parameter indicative of an inlet air pressure of the turbine air starter, and determining that a hydrostatic lock condition exists in the combustion engine based on both the speed threshold and the pressure threshold.

20 Claims, 7 Drawing Sheets

(51) Int. Cl.
*F02B 3/06* (2006.01)
*F02D 41/06* (2006.01)

(56) References Cited

U.S. PATENT DOCUMENTS

| | | | | |
|---|---|---|---|---|
| 4,494,499 | A | 1/1985 | Stein | |
| 6,035,626 | A * | 3/2000 | Wahl | F02C 7/275 290/40 A |
| 7,210,393 | B2 | 5/2007 | Lucidera | |
| 7,690,205 | B2 * | 4/2010 | Delaloye | F01D 19/00 60/786 |
| 8,380,388 | B2 * | 2/2013 | Shin | F02N 11/108 701/29.1 |
| 8,808,142 | B2 * | 8/2014 | Al-Khairy | F02N 7/08 477/167 |
| 8,862,364 | B2 * | 10/2014 | Kim | F02C 7/26 340/4.32 |
| 9,086,018 | B2 * | 7/2015 | Winston | F02C 7/26 |
| 9,151,180 | B2 * | 10/2015 | Veilleux, Jr. | F01D 17/16 |
| 9,874,149 | B2 * | 1/2018 | Harriet | F02C 7/275 |

OTHER PUBLICATIONS

International Search Report and Written Opinion issued in connection with corresponding PCT application No. PCT/US2015/039460 dated Mar. 4, 2016.

* cited by examiner

AIR STARTER AND METHODS FOR DETERMINING HYDROSTATIC LOCK

BACKGROUND OF THE INVENTION

A reciprocating engine, such as an internal combustion engine, is an engine that uses one or more reciprocating pistons to convert pressure into a rotating motion. In a typical example, a piston is housed in a sealable piston chamber or pressure chamber, and attached at its base to a rotatable shaft. As the piston slides along the piston chamber, the rotatable shaft is rotated, and vice versa. One example of a combustion cycle for the piston can include four piston strokes: intake stroke, compression stroke, combustion stroke, and exhaust stroke.

During the intake stroke, the piston is pulled out of the compression chamber, creating a vacuum, which draw in air from a sealable intake valve. Once the piston reaches the lowest point of its intake stroke, the intake valve is sealed, and the piston begins an upward compression stroke. The compression stroke slides the piston into the pressure chamber compressing the air. A combustible fuel can be added to the intake air prior to the intake stroke, or can be added during the compression stroke. At the end of the compression stroke, the air/fuel mixture is compressed in the pressure chamber until the mixture is combusted.

Combustion can occur due to the pressurized air/fuel mixture, or due to external ignition, such as a spark in the pressure chamber generated by a spark plug. During the combustion stroke, the explosion of the air/fuel mixture generates heat in the compressed gases, and the resulting expansion of the gases drives the piston away from the pressure chamber. Following the combustion stroke, a sealable outlet valve opens, and the piston is driven into the pressure chamber to push the combusted, or exhaust gases, out of the pressure chamber. The cycle of the combustion engine can then repeat.

Liquids in the cylinder can be problematic because liquids are relatively incompressible and when located in a combustion chamber where the fluids of combustion (air and fuel vapor) is normally compressed leads to a problem commonly known as hydrostatic lock. Hydrostatic lock occurs when a volume of liquid greater than the volume of the cylinder at its minimum (end of the piston's stroke) enters the cylinder. Since most common liquids are incompressible the piston cannot complete its travel; either the engine must stop rotating or a mechanical failure occurs ultimately resulting in engine damage upon starting of the engine during a hydrostatic lock condition.

An air turbine starter (ATS) can be used to initiate the rotation of the engine. The ATS is often mounted near the engine and can be coupled to a high pressure fluid source, such as compressed air, which impinges upon a turbine wheel in the ATS causing it to rotate at a relatively high rate of speed. The ATS includes an output shaft that is coupled to the turbine wheel, typically through a reducing gear box, to the engine. The output shaft thus rotates with the turbine wheel. This rotation in turn causes the engine to begin rotating. If a cylinder fills with liquid while the engine is off, the engine will refuse to turn when a starting cycle is attempted and this can damage the starter or engine.

BRIEF DESCRIPTION OF THE INVENTION

In one aspect, an embodiment of the invention relates to a method of determining hydrostatic lock in a combustion engine during a start sequence with a turbine air starter, the method comprising during the start sequence of the combustion engine, monitoring a speed parameter indicative of a rotational speed of the turbine air starter and a pressure parameter indicative of an inlet air pressure of the turbine air starter, determining the monitored speed parameter satisfies a speed threshold, and the monitored pressure parameter satisfies a pressure threshold, in response to determining the monitored speed parameter satisfies the speed threshold and the monitored pressure parameter satisfies the pressure threshold, determining that a hydrostatic lock condition exists in the combustion engine, and in response to the determining that a hydrostatic lock condition exists providing an indication of the hydrostatic lock condition or ceasing the start sequence.

In another aspect, an embodiment of the invention relates to a turbine air starter assembly including a housing defining an interior with an air inlet and an air outlet defining a flow path through the housing, a rotatable turbine located within the flow path within the interior, a rotatable pinion gear extending exteriorly of the housing and configured to operably couple to a crankshaft of a combustion engine, a gear train coupling the rotatable turbine to the rotatable pinion gear, a pressure sensor providing a pressure output indicative of air pressure at the air inlet, a speed sensor providing a speed output indicative of the rotational speed of the pinion gear, gear train, or rotatable turbine, and a hydrostatic lock detection module configured to receive, during a start sequence, the pressure output and the speed output and determine a hydrostatic lock condition of the combustion engine based thereon and output a signal indicative of the hydrostatic lock condition.

In yet another aspect, an embodiment of the invention relates to a method of determining hydrostatic lock in a combustion engine with a turbine air starter, the method comprising during a start sequence of the combustion engine, monitoring a speed parameter indicative of a rotational speed of the turbine air starter and a pressure parameter indicative of an inlet air pressure of the turbine air starter, estimating a torque acting on the combustion engine based on the speed parameter and the pressure parameter, determining the estimated torque satisfies a torque threshold indicative of a hydrostatic lock condition, in response to determining the estimated torque satisfies the torque threshold, determining that a hydrostatic lock condition exists, and in response to the determining that a hydrostatic lock condition exists providing an indication of the hydrostatic lock condition or ceasing the start sequence.

DESCRIPTION OF EMBODIMENTS OF THE INVENTION

Embodiments of the invention can be implemented in any suitable environment including, but not limited to, an environment using a reciprocating engine regardless of whether the reciprocating engine provides a driving force or is used for another purpose, such as to generate electricity. For purposes of this description, such a reciprocating engine will be generally referred to as a combustion engine, or similar language. Such a combustion engine can be fueled by gasoline, natural gas, methane, or diesel fuel. Thus, a preliminary understanding of a combustion engine is provided.

Figure 1:
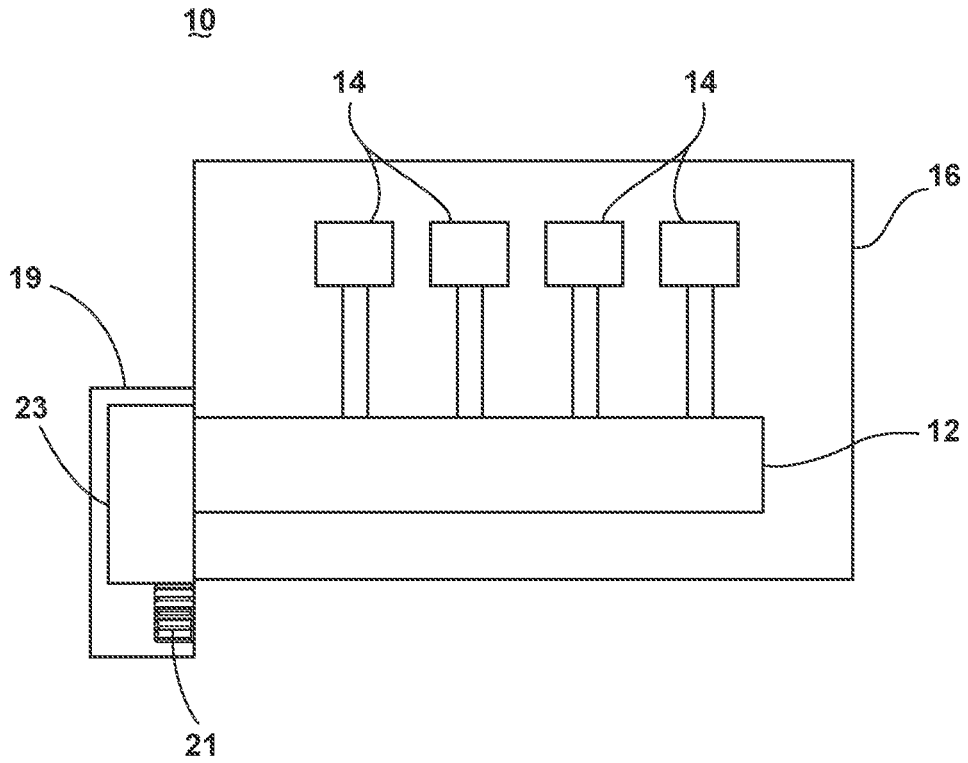
FIG. 1 is a schematic view of a combustion engine having a crank shaft that can utilize an air starting system in accordance with various aspects described herein.
Figure 2:
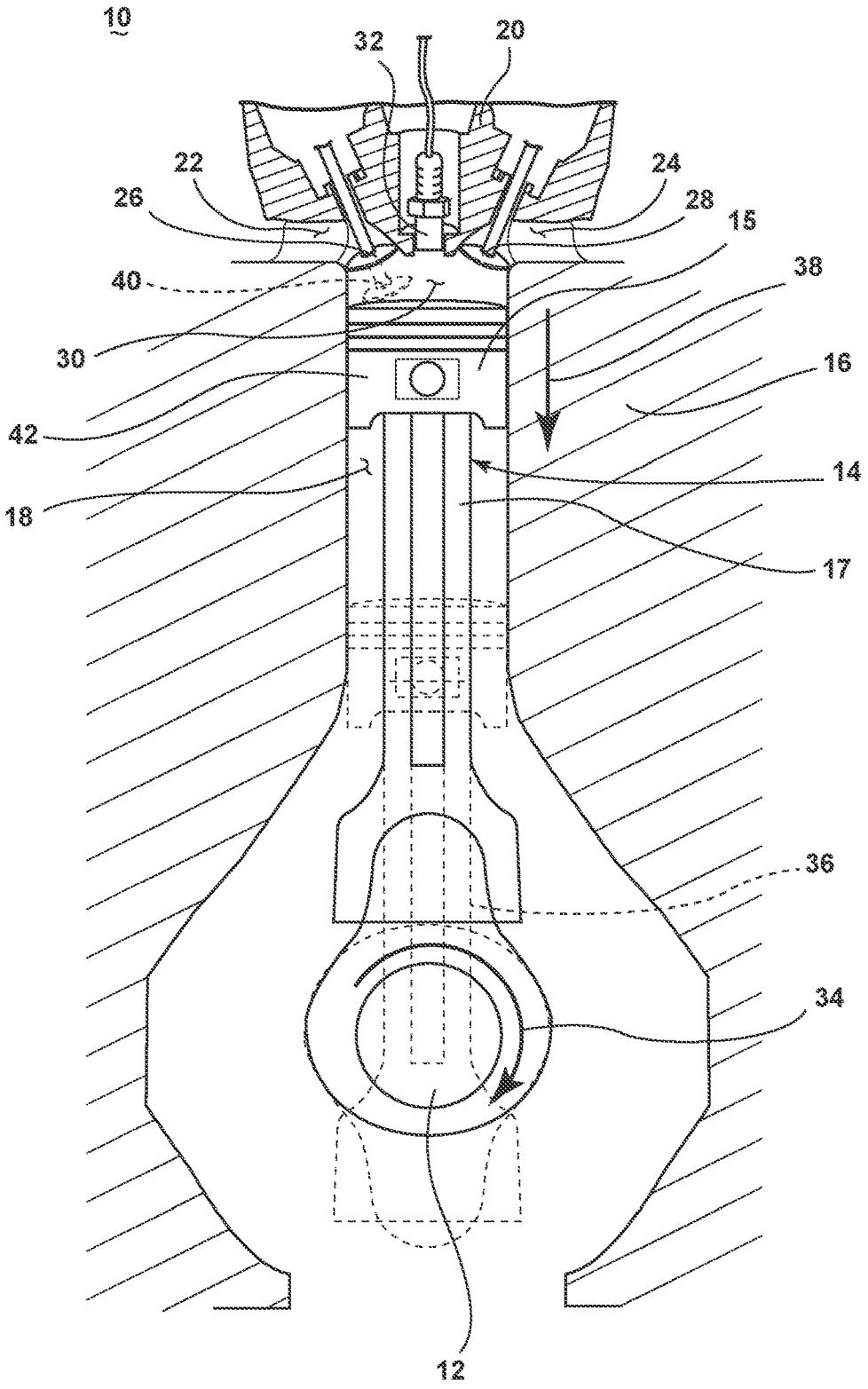
FIG. 2 is a schematic cross-sectional view of a piston in a combustion engine such as the engine of FIG. 1.

FIG. 1 illustrates a schematic view of a reciprocating engine, such as a combustion engine 10, having a rotatable shaft, such as a crankshaft 12, and at least one piston 14 located within an engine block 16. A gearbox 19 having a spline gear 21 and one or more internal gears or gear train 23 can be included and operably coupled with the crankshaft 12. As better illustrated in FIG. 2, the piston 14 located within the corresponding portion of the engine block 16 can include a piston head 15 rotatably coupled with a piston shaft 17, with the piston head being slidable within a piston chamber 18 (FIG. 2). The piston shaft 17 is rotatably coupled to a pin on the crankshaft 12, which is radially offset from a rotation axis of the crankshaft, such that rotation of the crankshaft 12 causes a reciprocation of the piston head 15 within the piston chamber 18.

While only one piston 14 is shown in FIG. 2, a combustion engine 10 typically has multiple pistons 14 contained within corresponding piston chambers 18, with the pistons 14 being mounted to different pins on the crankshaft 12, with the pins being radially spaced about the rotational axis of the crankshaft 12. The pistons 14 can be arranged in one or more linear rows, where an engine with only one row of linearly aligned pistons 14 being referred to as an inline arrangement. Engines 10 with multiple rows of pistons 14 can have an angular spacing between the rows forming. The pistons 14 can also be radially spaced about the crankshaft 12, which is often referred to as a radial arrangement.

The movement of the piston 14 into or out of the piston chamber 18 can, hereafter, be described as "strokes" or "piston strokes." While the disclosure can contain descriptions of "upward" strokes, wherein the piston 14 is moved farther into the piston chamber 18, away from the crankshaft 12, and "downward" strokes, wherein the piston 14 is removed from the piston chamber 18 toward the crankshaft 12, embodiments of the invention can include a combustion engine 10 having vertical, or angled strokes. Thus, the phrases "upward" and "downward" are non-limiting, relative terms for embodiments of the invention.

As shown, the combustion engine 10 can further include an engine head portion 20 having a sealable air intake passage 22 and a sealable exhaust passage 24. The passages 22, 24 are fluidly coupled with and sealable from the piston chamber 18 via a respective intake valve 26, and exhaust valve 28. Collectively, the piston head 15, engine block 16, head portion 20, intake valve 26, and exhaust valve 28 can define a sealable, compression chamber 30.

The head portion 20 can further include a fuel spray nozzle 32 for injecting a fuel, such as diesel fuel into the compression chamber 30 for combustion. While a fuel spray nozzle 32 for injecting diesel fuel is shown, alternative embodiments of the invention can include the fuel spray nozzle 32 optionally replaced by, in the example of a gasoline or natural gas engine, a spark plug for igniting an air/fuel or air/gas mixture for the combustion engine 10.

In one example, such as a combustion cycle, the combustion engine 10 can include four piston strokes: an intake stroke, a compression stroke, a combustion stroke, and an exhaust stroke. The foregoing description assumes the combustion cycle of the engine 10 starts while the piston 14 is fully extended upward into the piston chamber 18, which is typically referred to as "top dead center" or TDC. During the intake stroke, a rotation of the crankshaft (illustrated by clockwise arrow 34) pulls the piston 14 out of the compression chamber 30 in a downward intake stroke (in the direction of arrow 38), creating a vacuum in the compression chamber 30. The vacuum draws in air from the sealable intake passage 22, which is unsealed due to the opening of the intake valve 26 (illustrated in dotted line 40) and timed to correspond with the intake stroke.

Once the piston 14 reaches the lowest point of its intake stroke (illustrated in dotted line 36), the intake valve 26 is sealed, and the piston begins an upward compression stroke. The compression stroke slides the piston 14 into the pressure chamber 30 compressing the air. At the TDC position of the compression stroke 42, the fuel spray nozzle 32 can inject diesel fuel into the compression chamber 30. Alternatively, a combustible fuel can be added to the intake air prior to the intake stroke, or fuel can be added to the compression chamber 30 during the compression stroke 42.

Combustion can occur in the compression chamber due to the high heat and high pressure of the compressed air/fuel mixture (for example, in a diesel engine), or, alternatively, due to external ignition, such as a spark generated by a spark plug (for example, in a gasoline or natural gas engine) in the compression chamber 30.

During the combustion stroke, the explosion of the air/fuel mixture generates heat in the compressed gases, and the resulting expansion of the explosion and expanding gases drives the piston in a downward stroke, away from the compression chamber 30. The downward stroke mechanically drives the rotation 34 of the crankshaft 12.

Following the combustion, the exhaust valve 28 is unsealed to correspond with the exhaust stroke, and the piston is driven upward into the compression chamber 30 to push the combusted, or exhaust gases, out of the compression chamber 30. Once the piston 14 returns to the TDC position in the piston chamber 18, the combustion cycle of the engine 10 can then be repeated.

While a typical combustion engine 10 can have a set of pistons 14 and piston chambers 18, a single piston 14 is illustrated and described here for brevity. It will be understood that "a set" as used herein can include any number including only one. In a combustion engine 10 with multiple pistons 14, the pistons 14 can be configured along the crankshaft 12 to stagger the piston 14 strokes, such that one or more pistons 14 can be continuously providing a driving force to rotate the crankshaft 12, and thus drive the pistons 14 through additional combustion cycle strokes. The mechanical force generated by the rotation of the crankshaft 12 can be further delivered to drive another component, such as a generator, wheels, or a propeller.

Figure 3:
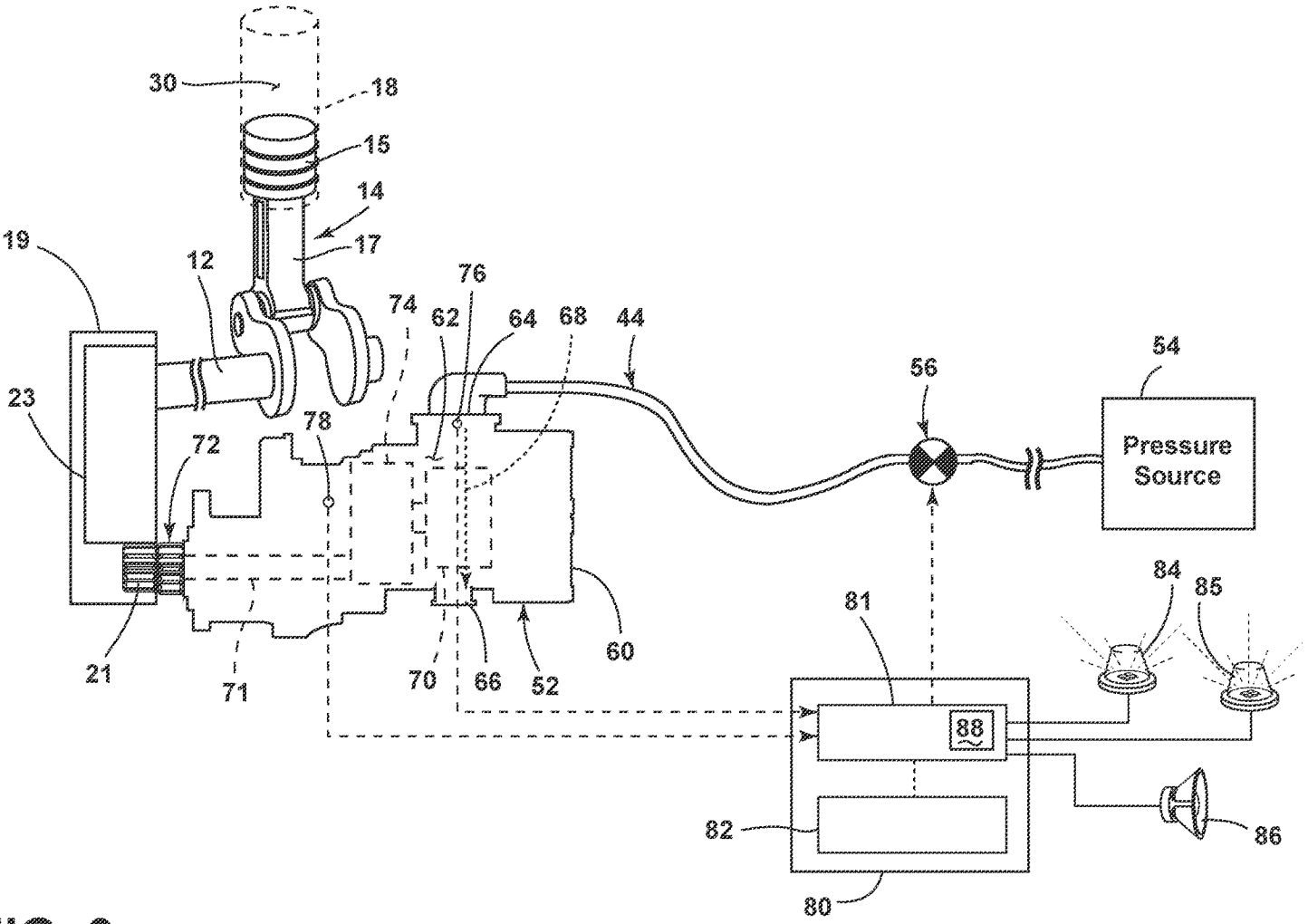
FIG. 3 is a partially schematic view of an air starting assembly rotationally coupled with the crankshaft of the engine of FIGS. 1 and 2, in accordance with various aspects described herein.

FIG. 3 illustrates an exemplary schematic configuration of an air starting system 44 such as for the combustion engine 10. The air starting system 44 can include a turbine air starter assembly 52 fluidly coupled with a pressure source 54 via a control valve 56. A housing 60, rotatable turbine 70, rotatable shaft 71, pinion gear 72, gear train 74, pressure sensor 76, speed sensor 78, and hydrostatic lock detection module 80 are included within the turbine air starter assembly 52. More specifically, the housing 60 defines an interior 62 with an air inlet 64 and an air outlet 66 defining a flow path 68 through the housing 60. The rotatable turbine 70 is located within the flow path 68 within the interior 62.

The rotatable pinion gear 72 extends exteriorly of the housing 60 and is operably coupled to the rotatable turbine 70 such that rotation of the rotatable turbine 70 causes rotation of the rotatable pinion gear 72. By way of non-limiting example, the gear train 74 and rotatable shaft 71 can couple the rotatable turbine 70 to the rotatable pinion gear 72. The rotatable pinion gear 72 is further configured to operably couple to the crankshaft 12 of the combustion engine 10. In the illustrated example, the rotatable pinion gear 72 includes a set of teeth keyed to mesh with the spline gear 21 of the gearbox 19, which is operably coupled to the crankshaft 12. Embodiments of the invention are envisioned wherein the turbine air starter assembly 52 is, for example, mechanically or removably mounted to the combustion engine 10. Alternatively, the turbine air starter assembly 52 can be capable of controllably extending and retracting the rotatable pinion gear 72 portion of the turbine air starter assembly 52. Additional configurations are envisioned.

The pressure sensor 76 can be configured to sense or measure air pressure at the air inlet 64. In this manner, the pressure sensor 76 can provide a pressure output indicative of air pressure at the air inlet 64 to the hydrostatic lock detection module 80. The speed sensor 78 can be configured to sense, measure, or estimate a rotational speed the pinion gear 72, gear train 74, or rotatable turbine 70. The speed sensor 78 can provide a speed output indicative of the rotational speed of at least one of the pinion gear 72, gear train 74, or rotatable turbine 70 to the hydrostatic lock detection module 80.

The hydrostatic lock detection module 80 can be configured to obtain, acquire or otherwise receive the pressure output and the speed output, and determine a hydrostatic lock condition of the combustion engine 10 based thereon. While the hydrostatic lock detection module 80 has been illustrated as separate from the housing 60 it will be understood that the hydrostatic lock detection module 80 can alternatively be incorporated within the housing 60 or be mounted thereto. The hydrostatic lock detection module 80 can also be configured to output a signal indicative of the hydrostatic lock condition. By way of non-limiting example, the hydrostatic lock detection module 80 can include a processor 81 configured to compare the pressure output to a pressure threshold and the speed output to a speed threshold, and determine the hydrostatic lock condition exists when the comparing indicates a satisfying of both the speed threshold and the pressure threshold. The processor can also be configured to estimate a torque acting on the combustion engine 10 based on the speed output and the pressure output, compare the estimated torque to a torque threshold indicative of a hydrostatic lock condition, and determine that a hydrostatic lock condition exists in the combustion engine 10 when the comparison indicates the estimated torque satisfies the torque threshold. The term "satisfies" is used herein to mean that the output satisfies the corresponding predetermined threshold, such as being equal to, less than, or greater than the corresponding predetermined threshold. It will be understood that such a determination can easily be altered to be satisfied by a positive/negative comparison or a true/false comparison.

The hydrostatic lock detection module 80 can further include memory 82 in which is stored operational profile(s), for operating the turbine air starter assembly 52 to determine a hydrostatic lock condition, as well as threshold information. The memory 82 can include random access memory (RAM), read-only memory (ROM), flash memory, or one or more different types of portable electronic memory, such as discs, DVDs, CD-ROMs, etc., or any suitable combination of these types of memory. The hydrostatic lock detection module 80 can be operably coupled with the memory 82 such that one of the hydrostatic lock detection module 80 and the memory 82 can include all or a portion of a computer program having an executable instruction set for controlling the operation of the pressure valve 56, turbine air starter assembly 52, and/or the operating method. The program can include a computer program product that can include machine-readable media for carrying or having machine-executable instructions or data structures stored thereon. Such machine-readable media can be any available media, which can be accessed by a general purpose or special purpose computer or other machine with a processor. Generally, such a computer program can include routines, programs, objects, components, data structures, algorithms, etc., that have the technical effect of performing particular tasks or implement particular abstract data types. Machine-executable instructions, associated data structures, and programs represent examples of program code for executing the exchange of information as disclosed herein. Machine-executable instructions can include, for example, instructions and data, which cause a general purpose computer, special purpose computer, hydrostatic lock detection module 80, or special purpose processing machine to perform a certain function or group of functions. In implementation, the pressure threshold and speed threshold can be converted to an algorithm, which can be converted to a computer program comprising a set of executable instructions, which can be executed by the processor 81.

The hydrostatic lock detection module 80 is also shown further coupled with optional indicators capable of outputting a human-detectable signal to alert a user to the hydrostatic lock condition or to alert the user that the combustion engine 10 can be started. It can be easily understood that a human-detectable signal is any signal capable of being detected by a user. Such indicators can include a visible or light-type indicator or an audible-type indicator or any combination of visible or audible human-detectable signals. Examples of light type indicators can include an incandescent lamp, a light emitting diode (LED), or an array of several LEDs. It should be noted that the light type indicator can produce a single light pulse or a series of light pulses. Examples of audible indicators can include any suitable sound generator capable of producing a beep, a series of beeps, an audible sound, or voice messages. In the illustrated example, an alarm light 84, an OK to start engine light 85, and a speaker 86 are illustrated as being operably coupled with the processor hydrostatic lock detection module 80. The hydrostatic lock detection module 80 or the processor 81 can also be configured to relay or send indicia or information regarding the hydrostatic lock condition. By way of non-limiting example, a text, an email, or another type of message can be transmitted to a user or sent to a database for storage or processing.

Further still, a response module 88 can be included either as a portion of the hydrostatic lock detection module 80, as illustrated, or separate therefrom. The response module 88 can be configured to receive the signal indicative of the hydrostatic lock condition from the hydrostatic lock detection module 80 and cease the start sequence based thereon. Alternatively, the response module 88 can also relay information or control the optional indicators 84, 85, and 86.

The pressure valve 56 can include a controllable relay valve capable of regulating the air pressure supplied by the pressure source 54 to the turbine air starter assembly 52, in response to a control signal supplied by the hydrostatic lock detection module 80. The pressure valve 56 can further include a pressure sensor 76 capable of sensing or measuring the air pressure supplied to the turbine air starter assembly 52, and generating an analogue or digital signal representative of the air pressure supplied to the turbine air starter assembly 52. The pressure valve 56 can further provide this pressure sensor 76 signal to the hydrostatic lock detection module 80, for instance, as part of a feedback loop to ensure proper pressure valve 56 operation.

During operation, the turbine air starter assembly 52 and pressure valve 56 operate to generate force, such as a torque at the rotatable pinion gear 72, in response to a provided supply of air pressure. The torque generated by the turbine air starter assembly 52 is applied (via the gearbox 19 and crankshaft 12) to generate the compression force used by the compression stroke to compress the contents of the compression chamber 30 (sans combustion), as explained above. The air supplied by the pressure valve 56 to the turbine air starter assembly 52 can be variable, including non-continuous, due to the low speed operation necessary for adequate slow roll performance. For example, the hydrostatic lock detection module 80 can control the pressure valve 56 to provide bursts of supply air to keep the combustion engine 10 rotating at predicted or target speed.

While the slow roll of the engine 10 is occurring, the hydrostatic lock detection module 80 receives the pressure output from the pressure sensor 76 and the speed output from the speed sensor 78. The hydrostatic lock detection module 80 can compare the pressure output and the speed output to corresponding threshold values to determine if a hydrostatic lock condition exists. For example, if the corresponding thresholds are satisfied, then it can be determined that the piston chamber 18 contains an incompressible liquid, for example, water and that a hydrostatic lock condition exists. As the determined hydrostatic lock condition can cause damage to the combustion engine 10, the operation of the turbine air starter assembly 52 and application of torque to the crankshaft 12 can be stopped. In such an instance, the incompressible liquid would not damage the combustion engine 10, piston 14, or other components. In addition to ceasing the application of torque and the reciprocation of the pistons 14, the hydrostatic lock detection module 80 can provide indicia of the determined hydrostatic lock condition. By way of non-limiting example, the indicia can be in the form of visual indicia, such as blinking light, or audible indicia, such as an alarm or sound, on either of the alarm light 84 or speaker 86. By way of further non-limiting examples, the indicia can include text, email or other message notifications transmitted to a user or sent to a database for storage or processing.

Alternatively, if the corresponding thresholds are not satisfied, then it can be determined that a hydrostatic lock condition does not exist, and the hydrostatic lock detection module 80 can output a signal to the response module 88, or a separate controller, that the combustion engine 10 can be started. Additionally or alternatively, the response module 88, or a separate controller, can continue to control the turbine air starter assembly 52 and pressure valve 56 to effect a starting of the combustion engine 10. By way of non-limiting example, the response module 88 can increase the air supplied by the pressure valve 56, which in turn increases the torque applied to the crankshaft 12 by the turbine air starter assembly 52, to increase the engine speed to an appropriate level to start the combustion engine 10.

Figure 4:
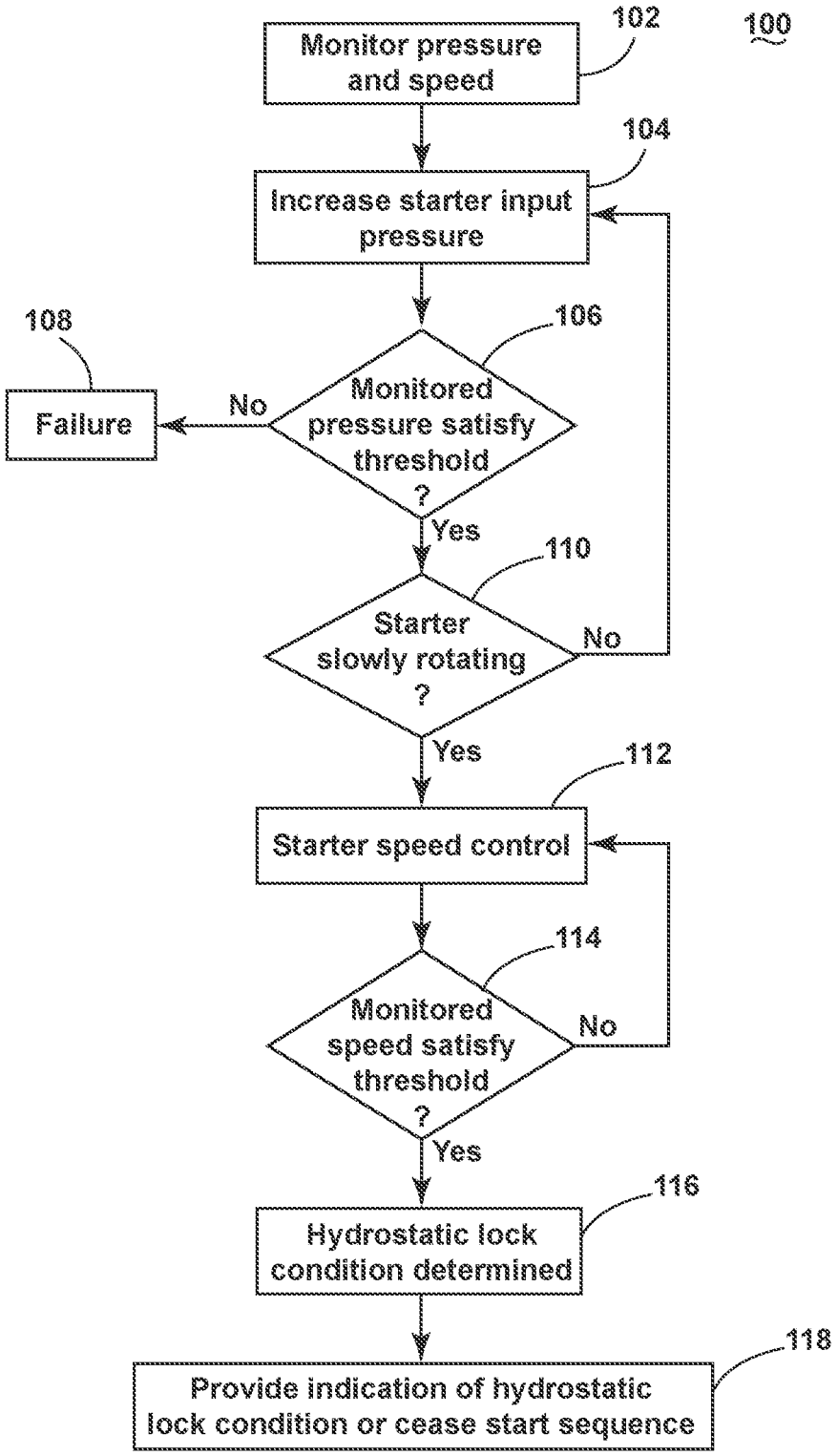
FIG. 4 is a flow chart illustrating a method of determining hydrostatic lock in accordance with various aspects described herein.

In accordance with an embodiment of the invention, FIG. 4 illustrates a method 100, which can be used for determining hydrostatic lock in a combustion engine such as the combustion engine 10 during a start sequence with a turbine air starter such as the turbine air starter assembly 52. The method 100 includes monitoring speed and pressure parameters related to the turbine air starter assembly 52, comparing the parameters to corresponding thresholds, and determining that a hydrostatic lock condition exists in the combustion engine based thereon.

Initially, the turbine air starter assembly 52 is turned on during the start sequence of the combustion engine 10 and a pressure parameter indicative of air pressure at the air inlet 64 is monitored and a speed parameter that is indicative of a rotational speed of the turbine air starter assembly 52 is monitored at 102. With respect to the turbine air starter assembly 52 described above the pressure parameter can be received from the pressure sensor 76. Further, with respect to the turbine air starter assembly 52 described above the speed parameter can be received from the speed sensor 78 and thus can be indicative of the rotational speed of at least one of the pinion gear 72, gear train 74, or rotatable turbine 70.

The term "start sequence" as used herein includes a sequence that causes movement of the piston 14 in the piston chamber 18 without any combustion. Further, the term "start sequence" can be considered a pre-start sequence, that is, operations prior to attempting to start the engine 10 into a self-sufficient operating mode, including prior to a compression stroke in the combustion engine 10. During the sequence, the combustion engine 10 can disable aspects of the combustion cycle that would result in the combustion of the fuel. For example, the combustion engine 10 can disable the injection of fuel, operation of spark plugs, etc. It is contemplated that pulses of regulated air can be provided to the turbine air starter assembly 52 to drive the combustion engine 10 during the start sequence. More specifically, the turbine air starter assembly 52 can be utilized to provide force to rotate the crankshaft 12 during the slow start method, which can effect a movement of the piston 14 in the piston chamber 18 through the combustion cycle, without any combustion.

At 104, the pressure supplied to the turbine air starter assembly 52 is increased. This can include, but is not limited to, that the air pressure is slowly increased, increased in steps, or ramped in a number of stages. At 106, it is determined if the monitored pressure satisfies the pressure threshold. By way of non-limiting example, satisfying the pressure threshold can include the monitored pressure parameter being below the pressure threshold. It is contemplated that any suitable pressure threshold can be utilized including, but not limited to, that satisfying the pressure threshold can include the monitored pressure parameter being below a maximum input pressure. If it is determined that the pressure threshold has not been satisfied, then a failure can be determined at 108. Such a failure can include, but is not limited to, a failure in the turbine air starter assembly 52. In such an instance, the start sequence can be stopped. If it is determined that the pressure threshold has been satisfied, then the method can continue to 110.

At 110, it is determined if the turbine air starter assembly 52 has started rotating. If it is determined that the turbine air starter assembly 52 has not started at least slowly rotating, then the pressure is increased further at 104. If it is determined that the turbine air starter assembly has started rotating, then the turbine air starter assembly 52 can be controlled at 112. More specifically, the speed of the turbine air starter assembly 52 can be controlled by controlling the control valve 56 and controlling the air to the air inlet 64. The control at 112 can include a period of drive and coast cycles during which the turbine air starter assembly 52 and pressure valve 56 are controlled by the hydrostatic lock detection module 80 to control the speed of the combustion engine 10 during a set of revolutions.

At 114, it is determined whether the monitored speed parameter satisfies the speed threshold. By way of non-limiting example, satisfying the speed threshold can include the monitored speed parameter being below the speed threshold. Further still, satisfying the speed threshold can include the monitored speed parameter being below the speed threshold for a predetermined period of time. It is contemplated that any suitable speed threshold can be utilized including, but not limited to, a speed deceleration threshold. By way of non-limiting example, satisfying the speed threshold can include the monitored speed parameter being below a predetermined number of rotations per minute (e.g., two rotations per minute). If it is determined that the speed threshold has not been satisfied, then the starter speed can continue to be controlled at 112.

If it is determined that the speed threshold has been satisfied, then it can be determined at 116 that a hydrostatic lock condition exists in the combustion engine 10. In this manner, the hydrostatic lock condition is determined when the comparing indicates a satisfying of both the speed threshold and the pressure threshold. When a hydrostatic lock condition is determined to exist at 116, the start sequence can be stopped at 118 including operation of the turbine air starter assembly 52 and any application of force to the crankshaft 12. Alternatively or in addition to stopping the start sequence, an indication of the determined hydrostatic lock condition can be provided. This can include, but is not limited to, that a human-detectable signal can be provided to alert a user to the hydrostatic lock condition or that information regarding the hydrostatic lock condition can be sent to a user or to a database.

During the start sequence the combustion engine 10 can be driven slowly to create a slow starting. As used herein, "slow starting" is used to describe rotating the crankshaft 12 at a speed below operational or self-sufficient running, engine speed, such as an idle speed. One non-limiting example of a "slow starting" can vary the rotation speed of the crankshaft 12 to a target speed of between ten and forty RPMs. While the target speed can be between 10 and 40 RPMs, temporal speeds outside of those ranges can be anticipated. Such slow speeds, or "slow roll" operation of the method can allow for a hydrostatic lock condition to be identified before any internal damage can occur to the combustion engine 10. Alternative "slow starting" engine speeds, engine speed targets, or speed ranges can be included.

The above-described sequence of the method 100 is for exemplary purposes only and is not meant to limit the method in any way, as it is understood that the portions of the method can proceed in a different logical order, additional or intervening portions can be included, or described portions of the method can be divided into multiple portions, or described portions of the method can be omitted without detracting from the described method. By way of non-limiting example, while the monitoring of the speed parameter was indicated as starting at 102, the speed parameter can be monitored only after the pressure to the turbine air starter assembly 52 has been increased. Further, if a hydrostatic lock condition is not determined with a predetermined amount of time, then it can be determined that one does not exist and the combustion engine 10 can be fully started.

Figure 5:
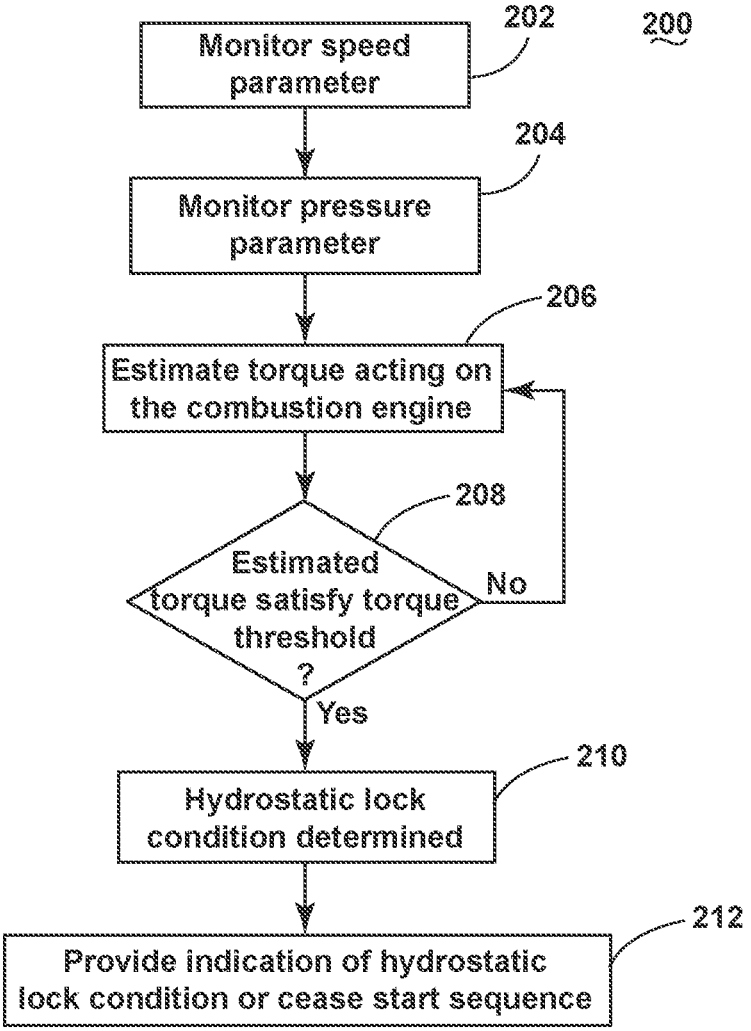
FIG. 5 is a flow chart illustrating a method of determining hydrostatic lock in accordance with various aspects described herein.

FIG. 5 is a flow chart showing an alternative method 200 of determining hydrostatic lock. The method 200 is similar to the method 100 therefore it will be understood that the description of the first method applies to the second method, unless otherwise noted. For example, one similarity is that the speed parameter is monitored at 202 and the pressure parameter is monitored at 204. With the speed parameter indicative of a rotational speed of the turbine air starter assembly 52 including the pinion gear 72, gear train 74, or rotatable turbine 70 and the pressure parameter indicative of air pressure at the air inlet 64.

The major difference is that a hydrostatic lock condition is determined at 210 based on an estimate of the torque acting on the combustion engine 10. The torque is estimated from the monitored speed parameter and pressure parameter of the turbine air starter assembly 52 at 206. For example, torque can be determined utilizing the equation (1):

$$T = \frac{\dot{m}}{g} r(\Delta CU) \tag{1}$$

where, $T$ = torque, $\dot{m}$ = Air mass (Density, Air speed and Pressure), $r$ = Tube Radius, and $\Delta CU$ = Change of velocity.

At 208, it is determined if the estimated torque satisfies a torque threshold. Satisfying the torque threshold can include, but is not limited to, the estimated torque being above the torque threshold. If the torque threshold is satisfied, then the hydrostatic lock condition is determined at 210. The start sequence can be ceased at 212 or an indication can be provided that a hydrostatic lock condition has been determined at 212. If the torque threshold is not satisfied, then the method can continue to monitor the estimated torque at 206. Further, if the torque threshold is not satisfied, it can be determined that a hydrostatic lock condition does not exist and the combustion engine 10 can be started. It will be understood that the estimated torque need not be a numerical value and can instead be interpreted or gauged based on the values of the monitored speed parameter and pressure parameter. The correlation between the pressure parameter, the speed parameter, and the torque generated by the turbine air starter assembly 52 can include a linear and/or a non-linear increasing and/or decreasing relationship. In one example, the relationship between the pressure, speed, and the corresponding torque can be defined in, for instance, a lookup table stored in the memory 82 of the hydrostatic lock detection module 80. It will be understood that there can be a large difference in the estimated torque between the existence of a hydrostatic lock condition and no hydrostatic lock condition. By way of non-limiting example, the expected torque variation can be over twenty-five percent within a predetermined time period such as two seconds.

The time period can be utilized to verify that the torque continues increasing over the period of time and to rule out a false signal or brief load variation due to operational conditions.

The above-described sequence is for exemplary purposes only and is not meant to limit the method in any way, as it is understood that the portions of the method can proceed in a different logical order, additional or intervening portions can be included, or described portions of the method can be divided into multiple portions, or described portions of the method can be omitted without detracting from the described method.

Figure 6:
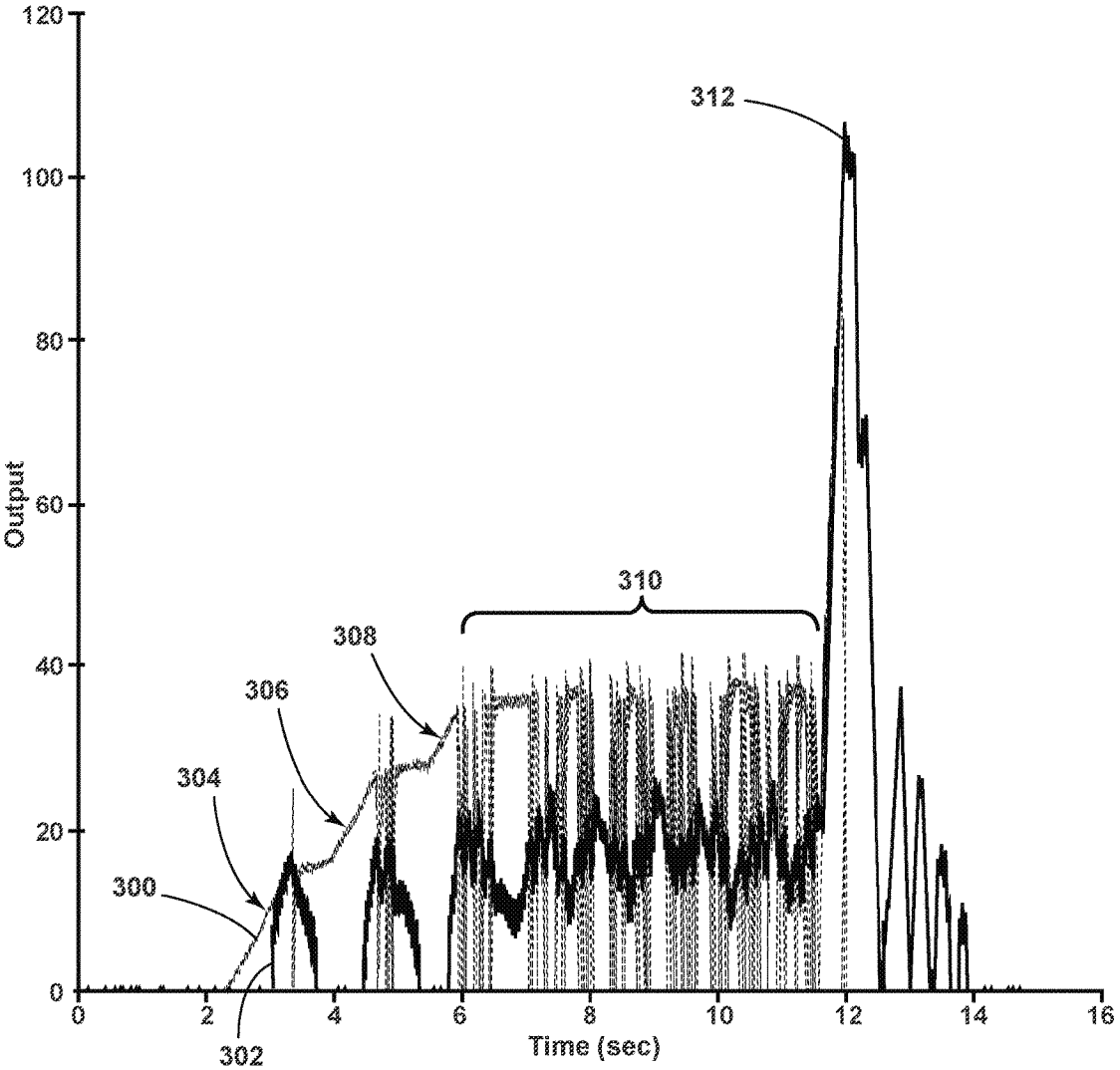
FIG. 6 are a set of example plots illustrating exemplary pressure and speed outputs of a starter, such as that illustrated in FIG. 3, in normal slow-roll start in accordance with various aspects described herein.

FIG. 6 illustrates a set of example plots, illustrating a slow-roll start method wherein no errors occur, and the engine is started. The graphs provided are intended to illustrated one non-limiting example of the method, as described, and do not specifically represent any necessary signals, sensors, values, or operations of the method. A first graph 300 illustrates the pressure output (in PSIG) indicative of air pressure at the air inlet 64 over time. A second graph 302 illustrates the speed of the combustion engine 10 (in RPM). Initially, the hydrostatic lock detection module 80 can turn on the turbine air starter assembly 52, and begin supplying air pressure. In the illustrated example, the pressure is increased such that a first ramp 304, a second ramp 306, and a third ramp 308 in the air pressure at the air inlet 64 is output. The turbine air starter assembly 52 and air pressure supplied generate a torque, which begins to rotate the combustion engine 10 as shown in the second graph 302. At the end of the third ramp 308, the air starting system 44 has enough pressure for a speed control phase 310 to be started. The speed control phase 310 is a period of drive and coast cycles during which the turbine air starter assembly 52 and pressure valve 56 are controlled by the hydrostatic lock detection module 80 to control the speed of the combustion engine 10 during a set of revolutions. At 312, the hydrostatic lock detection module 80 has determined the combustion engine 10 is free of errors and safe to start. At such time the hydrostatic lock detection module 80 significantly increases the air pressure supplied to the turbine air starter assembly 52 to cause an increase in engine speed. In this example, it is not necessary to stop the engine or perform any additional method steps prior to starting the combustion engine 10. Stated another way, the combustion engine 10 can be started by the hydrostatic lock detection module 80, upon confirmation that no hydrostatic lock condition exists.

Figure 7:
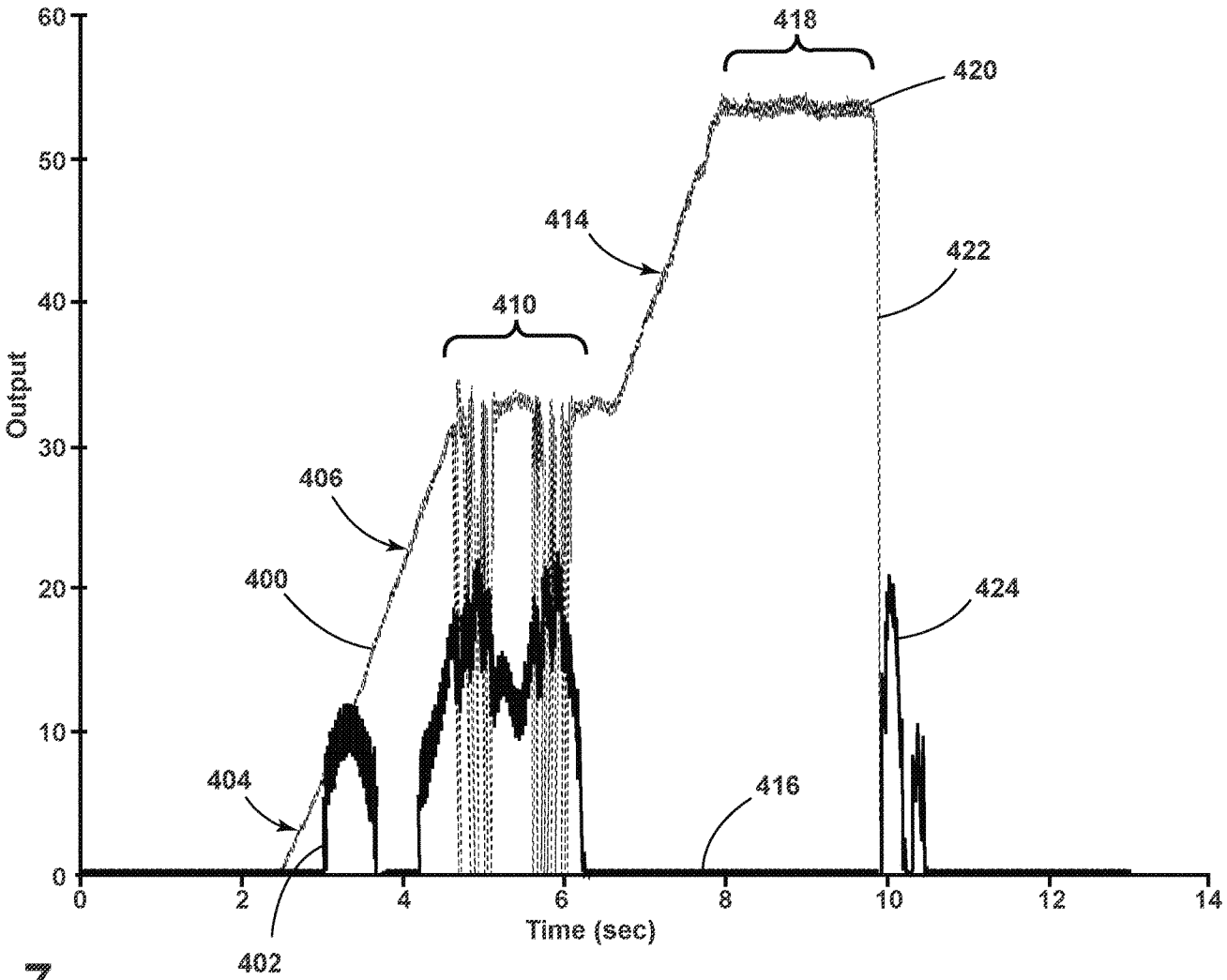
FIG. 7 are a set of example plots illustrating exemplary pressure and speed outputs of a starter, such as that illustrated in FIG. 3, when a hydrostatic lock condition exists in accordance with various aspects described herein.

FIG. 7 illustrates a set of plot graphs, illustrating a slow start method wherein a hydrostatic lock condition exists. The second set of example graphs are similar to that illustrated in FIG. 6; therefore, like parts will be identified with like numerals increased by 100, with it being understood that the description of the like parts of the first set of example graphs applies to the second set of example graphs, unless otherwise noted. Again, the second set of example graphs provided are intended to illustrated one non-limiting example of the method, as described, and do not specifically represent any necessary signals, sensors, values, or operations of the method.

The second set of example graphs includes a first graph 400 that illustrates the pressure output (in PSIG) indicative of air pressure at the air inlet 64 over time. A second graph 402 illustrates the speed of the combustion engine 10 (in RPM). Initially, the hydrostatic lock detection module 80 can turn on the turbine air starter assembly 52 and begin supplying air pressure. In the illustrated example, the pressure is increased such that a first ramp 404 and a second ramp 406 are created. The turbine air starter assembly 52 and air pressure supplied generate a torque, which begins to rotate portions of the turbine air starter assembly 52 as shown in the second graph 402.

At the end of the second ramp 406, the air starting system 44 has enough pressure and a speed control phase 410 is started during which the turbine air starter assembly 52 and pressure valve 56 are controlled by the hydrostatic lock detection module 80 to control the speed during a set of revolutions. At 414, the pressure continues to increase but the engine is stalled as indicated as 416 where the speed suddenly drops to zero RPM. The pressure is held at 418 and with engine still not moving a hydrostatic locking condition is determined. The pressure can be held for a predetermined period 420 before the hydrostatic locking condition is determined, although this need not be the case. At 422, the hydrostatic lock detection module 80 controls and lowers the air pressure supplied, to cease providing torque to the combustion engine 10. It is further illustrated that the engine speed can increase at 424 this can be due to recoil in response to the compression chamber 30 pressure generated by the hydrostatic lock condition rotating the crankshaft 12 in the reverse direction.

Many other possible embodiments and configurations in addition to that shown in the above figures are contemplated by the present disclosure. For example, in an engine having a plurality of pistons, the above-described methods can be equally applied to each piston such that a fault or error in any of the pistons can be detected and indicated to a user. In this scenario, embodiments of the invention can include indicia indicating an error or fault has occurred, and can be capable of indicating where the fault has occurred (i.e. in which compression chamber, etc.).

The embodiments disclosed herein provide a turbine air starter assembly and methods for determining hydrostatic lock in a combustion engine. The technical effect is that the above-described embodiments enable the application of a force to rotate the crankshaft to determine if a hydrostatic lock condition exists and stop the starting process before the engines suffer any damage. One advantage realized by the above-described embodiments is that the speed signal obtained from the turbine air starter assembly combined with the air pressure at the inlet are cleaner, more confident, and easier to process, in order to detect the presence of the hydrostatic lock condition than other known methods. By way of non-limiting example, a prior method used strain gauges located in the starter housing as an indirect method to measuring the applied torque. In such an instance, temperature variations, vibrations, and other loads, impact the signal resolution as well as the signal confidence. By way of further non-limiting example, direct torque measurement and devices that measure engine characteristics are expensive and can require re-design to include them. The above-described embodiments allow damage to the engine, requiring extensive and expensive repair, to be avoided. Another advantage of the above-described embodiments is that the method provides for indicia to a user that an error or fault has occurred or that the engine can be fully started.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of determining hydrostatic lock in a combustion engine started with a turbine air starter, the method comprising:

during a start sequence of the combustion engine, monitoring a speed parameter indicative of a rotational speed of the turbine air starter and a pressure parameter indicative of an inlet air pressure of the turbine air starter;

determining the monitored speed parameter satisfies a speed threshold and the monitored pressure parameter satisfies a pressure threshold;

in response to determining the monitored speed parameter satisfies the speed threshold and the monitored pressure parameter satisfies the pressure threshold, determining that a hydrostatic lock condition exists in the combustion engine; and in response to the determining that a hydrostatic lock condition exists providing an indication of the hydrostatic lock condition or ceasing the start sequence.

2. The method of claim 1 wherein pulses of regulated air are provided to drive the combustion engine during the start sequence.

3. The method of claim 1 wherein satisfying the speed threshold comprises the monitored speed parameter being below the speed threshold.

4. The method of claim 3 wherein satisfying the speed threshold comprises the monitored speed parameter being below the speed threshold for a predetermined period of time.

5. The method of claim 1 wherein providing the indication includes providing a human-detectable signal to alert a user to the hydrostatic lock condition.

6. The method of claim 1 wherein providing the indication includes sending information regarding the hydrostatic lock condition to a database.

7. The method of claim 1, further comprising increasing the air pressure to the turbine air starter during the start sequence.

8. The method of claim 7, wherein increasing the air pressure includes increasing the air pressure in steps.

9. The method of claim 7 wherein the rotational speed of the turbine air starter is monitored after the air pressure to the turbine air starter has been increased.

10. The method of claim 1 wherein ceasing the start sequence includes stopping operation of the turbine air starter.

11. The method of claim 1 wherein the start sequence is a pre-start sequence prior to a compression stroke in the combustion engine.

12. A turbine air starter assembly, comprising:

a housing defining an interior with an air inlet and an air outlet defining a flow path through the housing;

a rotatable turbine located within the flow path within the interior;

a rotatable pinion gear extending exteriorly of the housing and configured to operably couple to a crankshaft of a combustion engine;

a gear train coupling the rotatable turbine to the rotatable pinion gear;

a pressure sensor providing a pressure output indicative of air pressure at the air inlet;

a speed sensor providing a speed output indicative of a rotational speed of the pinion gear, gear train, or rotatable turbine; and a hydrostatic lock detection module configured to receive, during a start sequence, the pressure output and the speed output and determine a hydrostatic lock condition of the combustion engine based thereon and output a signal indicative of the hydrostatic lock condition.

13. The turbine air starter of claim 12 wherein the hydrostatic lock detection module comprises a processor configured to compare the pressure output to a pressure threshold and the speed output to a speed threshold and determine the hydrostatic lock condition when the comparing indicates a satisfying of both the speed threshold and the pressure threshold.

14. The turbine air starter of claim 12 wherein the hydrostatic lock detection module comprises a processor configured to estimate a torque acting on the combustion engine based on the speed output and the pressure output, compare the estimated torque to a torque threshold indicative of a hydrostatic lock condition, and determine that the hydrostatic lock condition exists in the combustion engine when the comparing indicates the estimated torque satisfies the torque threshold.

15. The turbine air starter of claim 12, further comprising a response module configured to receive the signal indicative of the hydrostatic lock condition and cease the start sequence based thereon.

16. A method of determining hydrostatic lock in a combustion engine started with a turbine air starter, the method comprising:

during a start sequence of the combustion engine, monitoring a speed parameter indicative of a rotational speed of the turbine air starter and a pressure parameter indicative of an inlet air pressure of the turbine air starter;

estimating a torque acting on the combustion engine based on the speed parameter and the pressure parameter;

determining the estimated torque satisfies a torque threshold indicative of a hydrostatic lock condition;

in response to determining the estimated torque satisfies the torque threshold, determining that a hydrostatic lock condition exists; and in response to the determining that a hydrostatic lock condition exists providing an indication of the hydrostatic lock condition or ceasing the start sequence.

17. The method of claim 16 wherein satisfying the torque threshold comprises the estimated torque being above the torque threshold.

18. The method of claim 16, further comprising increasing the air pressure to the turbine air starter during the start sequence.

19. The method of claim 18 wherein the rotational speed of the turbine air starter is monitored after the air pressure to the turbine air starter has been increased.

20. The method of claim 16 wherein ceasing the start sequence includes stopping operation of the turbine air starter.

* * * * *